United States Patent [19]

Wilson et al.

[11] 4,422,647

[45] Dec. 27, 1983

[54] VOLLEYBALL OUT OF BOUNDS DETECTING AND INDICATING SYSTEM

[76] Inventors: Wayne D. Wilson, 4934 Turquoise Cir., Colorado Springs, Colo. 80917; James J. Joyce, 7630 Topin Rd., Colorado Springs, Colo. 80908

[21] Appl. No.: 350,529

[22] Filed: Feb. 19, 1982

[51] Int. Cl.[3] ..... A63B 71/06

[52] U.S. Cl. ..... 273/411; 273/29 R; 340/323 R

[58] Field of Search ..... 273/411, 29 R, 31; 340/323 R

[56] References Cited

U.S. PATENT DOCUMENTS

| | | | |
|---|---|---|---|
| 3,415,517 | 12/1968 | Krist | 273/31 |
| 3,774,194 | 11/1973 | Jokay et al. | 273/31 X |
| 3,810,148 | 5/1974 | Karsten et al. | 273/29 R X |
| 3,883,860 | 5/1975 | Von Kohorn | 340/323 |
| 3,940,139 | 2/1976 | Barnes | 273/95 R |
| 3,982,759 | 9/1976 | Grant | 273/31 |
| 4,004,805 | 1/1977 | Chen et al. | 273/29 R |
| 4,092,634 | 5/1978 | Von Kohorn | 340/323 R |
| 4,109,911 | 8/1978 | Van Auken | 273/31 |

*Primary Examiner*—William H. Grieb

*Attorney, Agent, or Firm*—Donald J. Singer; Willard R. Matthews

[57] ABSTRACT

The detection and indication of volleyball out of bounds occurrences is realized by means of a light beam type system that distinguishes between the volleyball and other beam disrupting agents. Two juxtaposed light beams, one over the other, and separated by a distance equal to 1.5 volleyball diameters are projected along and 0.5 volleyball diameters outside of the sideline and endline bounds of the volleyball court. The beams are separately monitored by detectors that respond to beam interruptions. The lower beam is spaced from the playing surface by about three inches. Visual out of bounds indicators are actuated by a control circuit that responds exclusively to lower beam interruptions.

8 Claims, 3 Drawing Figures

FIG. 2
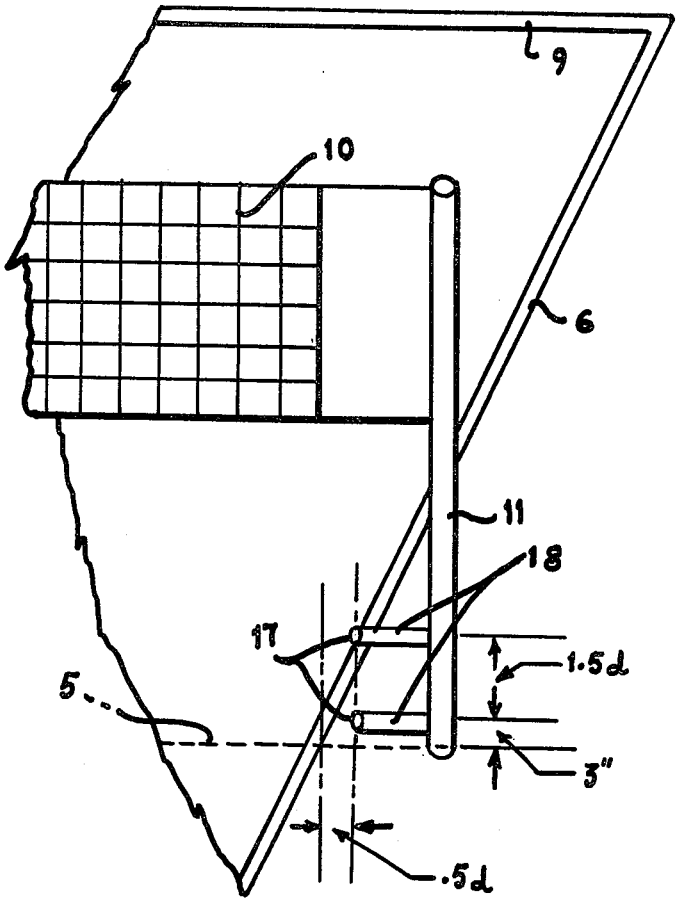
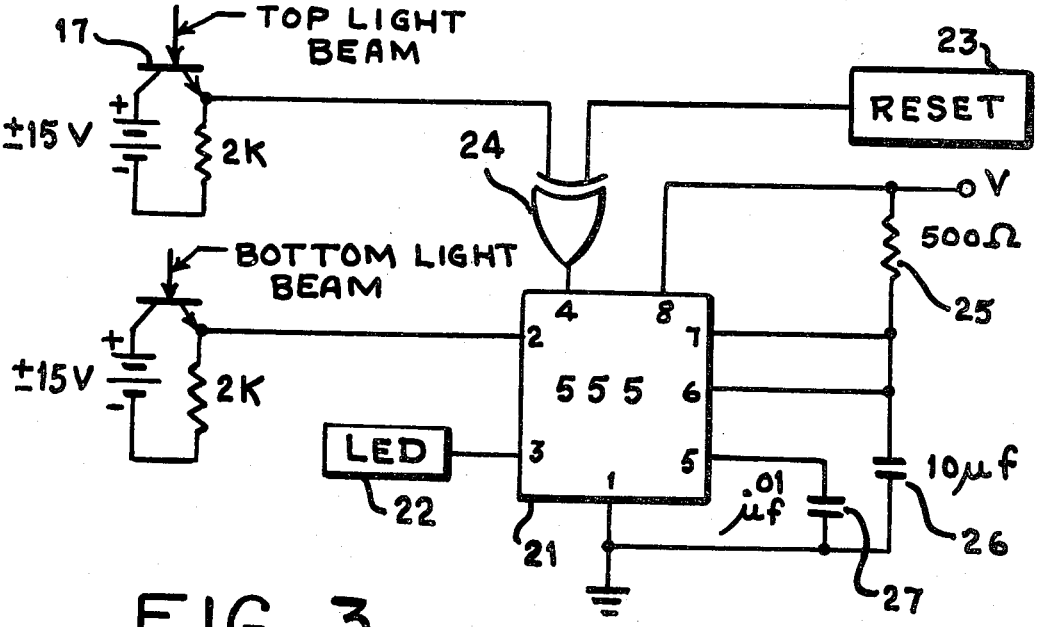
FIG. 3

VOLLEYBALL OUT OF BOUNDS DETECTING AND INDICATING SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to volleyball officiating aids and in particular to a volleyball out of bounds detecting and indicating system for improving the quality of judgement calls by officials during play.

The making of out of bounds calls by an official in a fast paced volleyball game is frequently one of judgement and in many instances must be made without assurance that the call is a correct one. In the event that the official is not close to the ball or if there are one or more intervening players screening his view the judgement must be based on where the ball apparently landed. Furthermore, since a ball landing on the line is considered in bounds the call is often critical and even closely observed events can be mis-called.

A review of the prior art reveals that there have been various attempts to solve this problem, especially in related court type sports such as tennis. Generally, apparatus for automatically indicating out of bounds events are either impact sensitive systems or electrical contact type systems. The U.S. Pat. No. 3,415,517 of H.K. Krist entitled *Automatic Impact Indication System for Tennis,* issued Dec. 10, 1968 and the U.S. Pat. No. 4,092,634 of H. Van Kohorn entitled *Electronic Indicator System for Ball Games,* issued May 30, 1978 are typical examples.

These systems, however, require making extensive permanent installations in the court and require complex electronic processing equipment. Furthermore, it is often necessary to adulterate the playing balls with either chemicals or electrically conductive elements thus degrading the quality of play.

Electronic eye type sensors have been proposed as a means for detecting out of bounds events. This approach has the advantage of simplicity and does not require permanent court installations. However, there exists the problem of triggering the system by player interruption of the light beam. No currently available system of this type is capable of distinguishing between ball and player.

In view of the foregoing it is seeen that there currently exists the need for court game out of bounds indicating equipment that is simple and inexpensive, that does not require expensive permanent court installation and that is not subject to the ambiguities of currently available electric eye type systems. The present invention is directed toward satisfying that need.

SUMMARY OF THE INVENTION

The volleyball out of bounds detecting and indicating system of the invention functions in response to the interruption of a light beam by the volleyball. Discrimination between player and volleyball incurred beam interruptions is achieved by use of dual light beams separated by a distance that permits interruption of only one beam at a time by the volleyball while insuring interruption of both beams by a player. The beams are parallel and positioned one above the other and an out of bounds indicating light is lit when the bottom beam only is interrupted.

Light beams are directed along each sideline from each end to center court. Phototransistor detectors located at center court receive the beams and output signals responsive to light beam interruptions. Light beams and phototransistor detectors are similarly positioned to monitor the end lines. A control circuit including exclusive OR gates receives the outputs of the phototransistor detectors and appropriately controls out of bounds indicating lights. Out of bounds event indicators can be reset manually or can time out automatically. False triggering of the bottom beam by a player's foot is avoided by positioning the bottom beam approximately three inches above the playing surface.

It is a principal object of the invention to provide a new and improved volleyball out of bounds detecting and indicating system.

It is another object of the invention to provide a volleyball out of bounds detecting and indicating system that does not require extensive permanent installations in the volleyball court.

It is another object of the invention to provide a volleyball out of bounds detecting and indicating system that does not require alteration of the volleyball.

It is another object of the invention to provide a volleyball out of bounds detecting and indicating system that is simple, inexpensive and can be fabricated of readily available components.

It is another object of the invention to provide a light beam implemented volleyball out of bounds detection and indicating circuit that distinguishes between player and volleyball light beam interruptions.

These together with other objects, features and advantages of the invention will become more readily apparent from the following detailed description when taken in conjunction with the illustrative embodiment in the accompanying drawings.

DESCRIPTION OF THE DRAWINGS

FIG. 2 is a partial view of the volleyball court of FIG. 1 showing location of the system light detectors; and FIG. 3 is a schematic diagram of the control circuit of the invention.

DETAILED DESCRIPTION OF THE PREFERRED EMBODIMENT

Figure 1:
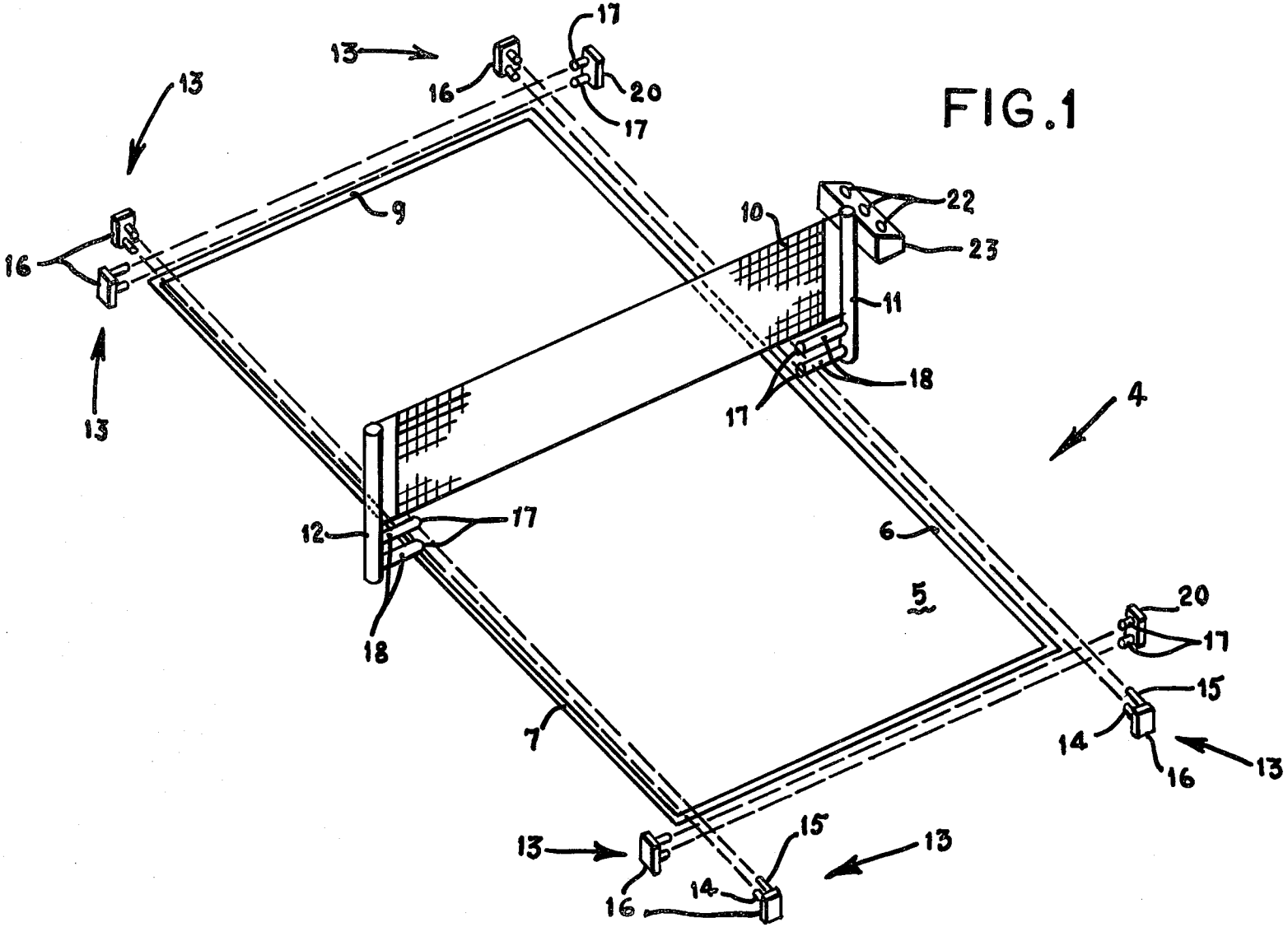
FIG. 1 is an isometric illustration of a volleyball court incorporating the out of bounds detecting and indicating system of the invention.

The present invention is an out-of-bounds detection system (OBDS) that uses light sources along the sidelines and endlines of a volleyball court. The light shines into receiver components located at the corners and at the middle of the court. The system encompasses two separate light sources for each line. These light sources are placed so that one source is higher than the other enabling a person to break both beams and not set off the system while they are spaced sufficiently to allow the ball to break the beam yet still set off the system.

It is a principal object of the invention that the out-of-bounds detection system (OBDS) be able to detect whether the ball landed out-of-bounds as opposed to in-bounds or on the line. This is true for both the end lines and side lines. The system must also be accurate enough to be depended on to assist officials in making close calls. The system consists of (a) light source, and (b) the receiving system which is composed of a control circuit, a control board and photocell receivers. The lights for the system are in six sets of pairs. Each pair shines down one side of the boundary of the court up to half court. These pairs of lights are placed one on top of the other with a distance of 1½ diameter of the ball apart.

The sets of lights are placed far enough away from the court so as not to interfere with the movement of the players during the course of a game. The lights on the bottom are positioned approximately 3 inches off the floor to allow a player's foot to pass beneath undetected. The lights shine a light beam parallel to its respective out of bounds line approximately 4.14 inches (or one ball radius) outside its line to allow for a ball to hit on the line and not be mistaken as out-of-bounds by the detection system.

The receiver system is broken into two parts; the receivers and the control board. The receiver system uses 12 detectors with each detector directly facing its respective light source. The receivers are placed far enough away from the court so as not to interfere with the movement of players during a game. The receiver sends a signal via wire to the control circuit and control board depending on how many detection systems are activated. In operation, when the lower light of a pair is broken it sends a signal and location to the control board showing where the ball landed out-of-bounds. When both beams of a pair are simultaneously broken, the detection system sends a signal to the control circuit and control board which is ignored thus distinguishing between a ball out-of-bounds and a player interfering with the system.

The control board is the second part of the receiver system. A light emitting diode (LED) display lights up on the control board only when the ball lands out of bounds. The letters OBL can be used to designate out-of-bounds left, whereas the letters OBR designate out-of-bounds right, and the letters OBE designate out-of-bounds end. The respective light stays lits until either the referree resets the system through a reset button located on the control board or eight seconds have elapsed.

Referring now to FIG. 1 there is illustrated thereby a volleyball court 4 incorporating the out of bounds detecting and indicating system of the invention. The playing surface 5 of the court is shown bounded by sideline bounds 6 and 7 and endline bounds 8 and 9. Net 10 is supported at midcourt by posts 11 and 12. Six light sources 13 are positioned as shown and project light beams along the court bounds. Each light source 13 comprises a lower light projector 14, an upper light projector 15 and a suitable mounting fixture 16. As indicated above light projectors 14 and 15 are spaced by a distance of 1.5 volleyball diameters. Phototransistor detectors 17 mounted on support arms 18 receive the light beam from light source 13 at midcourt. Other phototransistor detectors 17 mounted on support member 20 receive the light beams from the end line light sources 13. The outputs of phototransistor detectors 17 are fed to display console 23 which contains the display control circuit and LED indicating lights 22.

A detail of the mounting of phototransistor detectors 17 on net post 11 is shown in FIG. 2. The various dimensions indicated are critical to the invention in that: the 0.5 d dimension (d being the diameter of a volleyball) prevents out of bounds indication for balls landing on the sideline; the 3 inch dimension prevents out of bounds indication from interruption of the lower beam by a player's foot; and, the 1.5 d dimension requires that a volleyball interrupt only one beam at a time thus distinguishing it from a player.

FIG. 3 is a schematic diagram of the control circuit of the system. It comprises IC 555 timer 21 having a timing circuit comprised of resistor 25 and capacitors 26, 27. The output of the phototransistor detector 17 receiving the top light beam is fed along with the reset signal from reset 23 to timer 21 through exclusive OR gate 24. The output of the phototransistor detector 17 receiving the bottom light beam is fed directly to timer 21 and timer 21 controls LED 22 directly in response to its inputs and its timing function. Although only visual indication (LED's) are shown other indicators such as audio signals are suitable and within the scope of the invention.

While the invention has been described in one presently preferred embodiment it is understood that the words which have been used are words of description rather than words of limitation and that changes within the purview of the appended claims may be made without departing from the scope and spirit of the invention in its broader aspects.

What is claimed is:

1. In combination with a volleyball court having a net and sideline and endline bounds defining a playing surface, a volleyball out of bounds detecting and indicating system comprising light beam generating means projecting light in the form of upper and lower juxtaposed light beams around the outer periphery of said playing surface said light beams being spaced apart a distance that prevents simultaneous interruption of both beams by a single volleyball, said light beams being positioned outside of and proximately spaced from said sideline and endline bounds with said lower beam being proximately spaced from said playing surface, detector means receiving said projected light and outputting signals in response thereto, and volleyball out of bounds indicating means receiving said detector means output signals and generating out of bounds indication signals exclusively in response to volleyball incurred light beam interruptions.

2. A volleyball out of bounds detecting and indicating system as defined in claim 1 wherein:

said upper light beam is positioned a distance of approximately 1.5 d vertically above said lower light beam, d being a distance equal to the diameter of a volleyball; and, said detector means outputs a discrete signal for each said light beam.

3. A volleyball out of bounds detecting and indicating system as defined in claim 2 wherein said lightbeams and said detection means are located a distance d/2 outside of said sideline and endline bounds.

4. A volleyball out of bounds detecting and indicating system as defined in claim 3 wherein said volleyball out of bounds indicating means comprises visual indicating means and a control circuit means, said control circuit means receiving from said detector means output signals responsive to said lower beam and output signals responsive to said upper beam, said control circuit means actuating said visual indicating means in response to signals responsive to said lower beam only.

5. A volleyball out of bounds detecting and indicating system as defined in claim 4 wherein:

said light beam generating means comprises;

a first light beam source located at the near court end and projecting lower and upper light beams along the left court sideline, a second light beam source located at the far court end and projecting lower and upper light beams along the left court sideline, a third light beam source located at the near court end and projecting lower and upper light beam long the right court sideline, a fourth light beam source located at the far court end and projecting lower and upper light beams along the right court sideline, a fifth light beam source located at the right side of the near court end and projecting lower and upper light beams along the near court end, and a sixth light beam source located at the right side of the far court end and projecting lower and upper light beams along the far court end;

said detector means comprises;

a first detector located at midcourt and receiving light from said first light beam source, a second detector located at midcourt and receiving light from said second light beam source, a third detector located at midcourt and receiving light from said third light beam source, a fourth detector located at mid court and receiving light from said fourth light beam source, a fifth detector located at the left side of the near court end and receiving light from said fifth light beam source, and a sixth detector located at the left side of the far court end and receiving light from said sixth light beam source; and said visual indicating means includes;

a visual indicator and a control circuit responsive to each said detector.

6. A volleyball out of bounds detecting and indicating system as defined in claim 5 wherein each said detector comprises an upper phototransistor receiving light from said upper beam and a lower phototransistor receiving light from said lower beam.

7. A volleyball out of bounds detecting and indicating system as defined in claim 6 wherein each said visual indicating means comprises an exclusive OR gate receiving the output of said upper phototransistor and a reset input, an IC timer receiving the output of said exclusive OR gate and the output of said lower phototransistor, and an LED, said LED being controlled by said IC timer.

8. A volleyball out of bounds detecting and indicating system as defined in claim 7 wherein said lower light beam is approximately three inches above said playing surface.

* * * * *